US005533712A

United States Patent [19]

Fujikawa et al.

[11] Patent Number: 5,533,712

[45] Date of Patent: Jul. 9, 1996

[54] ELECTRIC HOIST AND TRACTION APPARATUS

[75] Inventors: Masaru Fujikawa; Kazunori Tsuda; Munenobu Honda, all of Sayama, Japan

[73] Assignee: Elephant Chain Block Company Limited, Osaka, Japan

[21] Appl. No.: 160,788

[22] Filed: Dec. 3, 1993

[30] Foreign Application Priority Data

Dec. 18, 1992 [JP] Japan ..... 4-339243
Dec. 28, 1992 [JP] Japan ..... 4-347657

[51] Int. Cl.[6] ..... B66D 1/00

[52] U.S. Cl. ..... 254/362; 254/903; 310/75 R; 310/78; 464/46

[58] Field of Search ..... 464/30, 46, 47; 254/350, 362, 368, 372, 903; 310/75 R, 78, 76, 92, 94, 120

[56] References Cited

U.S. PATENT DOCUMENTS

| | | | |
|---|---|---|---|
| 2,297,988 | 10/1942 | Sawyer | 310/78 |
| 4,103,872 | 8/1978 | Hirasuka | 254/362 |
| 4,502,667 | 3/1985 | Nakamura | 254/903 |
| 4,508,318 | 4/1985 | Maeda . | |
| 4,588,913 | 5/1986 | Adami | 310/78 |
| 4,636,962 | 1/1987 | Broyden et al. . | |
| 5,081,385 | 1/1992 | Gajjar | 310/78 |

FOREIGN PATENT DOCUMENTS

| | | |
|---|---|---|
| 1406010 | 6/1965 | France . |
| 51-106950 | 9/1976 | Japan . |
| 63-3831 | 1/1988 | Japan . |

*Primary Examiner*—Katherine Matecki
*Attorney, Agent, or Firm*—Watson Cole Stevens Davis

[57] ABSTRACT

An elastic hoist and traction apparatus in which a friction receiving surface is provided at a rotor of a motor, and an overload prevention device is provided at the reverse side to a load on a brake for stopping a driving shaft and between the motor shaft and the friction receiving surface of the rotor or between the motor shaft and the driving shaft, thereby solving the problem created in that the overload prevention device is provided at the load side of the brake.

2 Claims, 9 Drawing Sheets

ELECTRIC HOIST AND TRACTION APPARATUS

FIELD OF THE INVENTION

The present invention relates to an electric hoist and traction apparatus, and more particularly to an electric hoist, and traction apparatus provided with a motor, a driving shaft, driven by the motor, and a load sheave driven in association with the driving shaft.

BACKGROUND OF THE INVENTION

Generally, the hoist and traction apparatus is provided with an overload prevention device which allows the load sheave to slip when subjected to an overload so that a load is restrained from being further hoisted or hauled in order to prevent the load-hoisting or -traction in the overload state exceeding a preset load.

The overload prevention device, as disclosed in, for example, the Japanese Patent Laid-Open Gazette No. Sho 51-106950, is provided at an intermediate shaft of a reduction gear mechanism provided between the driving shaft of the motor and the load sheave, in other words, between a second reduction gear and the intermediate shaft for supporting the reduction gear or is provided between the driving shaft and a first gear shaft of the reduction gear mechanism, as disclosed in, for example, the Japanese Patent Publication Gazette No. Sho 63-3831.

However, in the case where the overload prevention device is provided at the intermediate shaft, an axial length thereof is larger and a gear casing is enlarged to that extent to thereby create the problem in that the apparatus is large-sized as a whole. Usually, at the driving shaft is provided an electromagnetic brake, or, in some cases, a mechanical brake, for holding the hoist position when the motor stops. Since the overload prevention device is provided at the load side of the brake, that is, at the load sheave side, in the case where the hoist and lowering operation are in severe repetition, the so-called inching operations are performed, near a slip load set by the overload prevention device, in other words, preset set value of a transmitting torque, a friction plate of the overload prevention device is heated. As the result, in a case where the friction plate is changed in friction property of a friction member, extremely rarely, even when subjected to no external force, the overload prevention device slips to lower the load, thereby creating a problem because the load cannot be held at the predetermined position.

Also, in the case where the overload prevention device is provided between the driving shaft and the first gear shaft as disclosed in the Japanese Patent Publication Gazette No. Sho 63-3831, a problem will be created as follows:

The hoist and traction apparatus disclosed in the above-mentioned Gazette is provided with an overload prevention device in such a manner that the first gear shaft projects from a side plate at the motor side toward a motor room and one axial end of the driving shaft is fitted to be rotatably relative to the axial end of the projecting shaft portion so as to be supportingly connected with each other and then the overload prevention device is provided at a juncture of the axial end portions. Therefore, the latter problem of the conventional example is solved, but a total axial length of the first gear shaft and driving shaft becomes larger in comparison with the case where the over load prevention device is not provided, and the motor casing must be made larger so that the problem still remains in that the apparatus is as a whole of a large size. Moreover, the one axial end of the driving shaft is positioned in the motor room and supportingly filled into axial end of the first gear shaft, whereby it is difficult to align the first gear shaft and driving shaft. Also, the driving shaft, which is relative-rotatably supported to the axial end of the first gear end, causes deflection, thereby creating another problem in that wear is generated or noises are produced.

SUMMARY OF THE INVENTION

An object of the present invention is to provide an electric hoist and traction apparatus which can solve the above-mentioned conventional problem created in that the overload prevention device is provided at the side of the brake opposite to the motor, that is, at the load side and the total axial length of the apparatus increases, and which can facilitate aligning of the motor shaft or that of the motor shaft and driving shaft and also solve the problem that the motor shaft deflects.

In order to attain the above-mentioned object, the present invention is firstly characterized in that an electric hoist and traction apparatus, which is provided with a motor having a stator and a rotor,a motor shaft driven by the motor, and a load sheave driven in association with the motor shaft, is provided with an overload prevention device of the following construction: End rings provided at both axial ends of the rotor are coupled with hubs each having a bearing holding portion and a friction receiving surface, the rotor is rotatably supported relative to the bearing holding portions, a biasing member facing each hub is supported to the motor shaft so as to be not relatively rotatable but axially movable. A friction plate is interposed between the friction receiving surface of the hub and the biasing member, a load selling and adjusting member is threaded by engaged with the motor shaft on at least one outside surface of the biasing member supported to the motor shaft, and an elastic member supported to the motor shaft. An elastic member is interposed between the adjusting member and the biasing member.

Also, at each end ring provided at the axial ends of the rotor may directly be provided with the bearing holding portion and friction receiving surface so as to rotatably support the rotor to the driving shaft through the bearings held to the bearing holding portion of the end ring.

The present invention is secondly characterized in that the usual electric hoist and traction apparatus is provided with an overload prevention device in which the motor shaft and driving shaft aligned on the same axis are disposed opposite to each other between a pair of opposite side plates for supporting the load sheave, and between the motor shaft and the driving shaft are provided a receiving member not rotatably coupled with one of the motor shaft and driving shaft, a holding member rotatably coupled with the other, a friction member interposed between the receiving member and the holding member, and elastic member for biasing the holding member toward the receiving member, and an overload setting and adjusting member of adjusting a biasing force of the elastic member.

In this construction, it is preferably that at one of the axial ends of the motor shaft and driving shaft for coupling the holding member is provided a casing member having at one lengthwise end a receiving portion opposite to the receiving member, a cavity capable of housing in an intermediate portion thereof the receiving member and holding member, and internal thread at the other lengthwise end, so that the load setting and adjusting member threadedly engages with the internal thread of the casing member, and the receiving member, holding member, friction member and elastic member are housed and held in the cavity of the casing member and between the receiving member and the load setting and adjusting member, thereby preferably forming an overload prevention unit.

It is preferable that the holding member is formed of a sleeve and a flange, a holder is not-relative-rotatably but axially movably supported to the sleeve, the friction member is interposed between the holder and the flange, and the elastic member is interposed between the holder and the load setting and adjusting member.

The overload prevention unit may be formed in such a manner that the receiving member is formed of a juncture, such as splines, for not-relative-rotatably coupling with one of the motor shaft and driving shaft and of a cylindrical housing having a receiving portion, at the inside of the holding member is provided a juncture, such as splines, for not-relative-rotatably coupling with the other of the motor shaft and driving shaft, in the cylindrical housing is provided a shaft portion capable of being housed therein and a larger diameter portion, the load setting and adjusting member threadedly engages with the shaft portion of the holding member, the friction member and elastic member are interposed between the adjusting member and the receiving member, and the friction member is interposed between the receiving member and the larger diameter portion, so that the holding member is held threadedly engaged with the receiving member through the adjusting member to thereby form the overload prevention unit.

In the first characteristic of the present invention, the rotor of the motor is rotatably supported to the motor shaft and between the rotor and the motor shaft is provided the overload prevention device comprising the biasing member, friction plate, load setting and adjusting member and elastic member, whereby, even when an electromagnetic brake or a mechanical brake is provided at the motor shaft, the overload prevention device can be positioned at the reverse side of the brake to the load. Accordingly, as described in the conventional example, even when the friction plate varies in frictional due to temperature changes, the problem that the load controllably lowers, can be eliminated. Also, since the rotor of the motor is utilized, the axial length can be reduced to a greater extent than the conventional example so as to restrain, to that extent, the apparatus from being large-sized. Moreover, since the motor shaft can be supported at both ends to the side plate and motor casing through the bearings, even when a reduction gear mechanism is provided, the driving shaft and motor shaft are easy to align and also the motor shaft can be reduced in axial length, and the problem of causing deflection can effectively be solved.

Furthermore, the rotor is relative-rotatably supported at the axial outside thereof to the motor shaft, whereby the rotor can be less affected by a temperature rise during the driving than the case of providing the bearing within the rotor, and the bearing efficiency can be almost constant and moreover, the workability of the rotor can be improved.

In a case where the bearing holding portion and friction receiving surface are provided at each end ring without using the hub, the axial length can further be reduced and the apparatus can further be restrained from being large-sized.

In the second characteristic of the present invention,the rotor shaft and driving shaft are opposite to each other between the side plates and the overload prevention device is provided between the motor shaft and the driving shaft, whereby the device can be disposed at the reverse side of the mechanical brake to the load and the operational effect can be obtained to the same extent as the first characteristic. Furthermore, in the second characteristic, the motor is not specified but can use a standard one and the overload prevention device can be built in by use of a space between the side plates, whereby, while using the overload prevention device,the axial length is restricted. Hence, the problem created in that the motor casing or a gear casing becomes large-sized as the conventional example and the apparatus becomes larger as a whole,can be solved. On the other hand, the motor shaft, which is opposite to the driving shaft between the side plates, can be supported at, both the axial ends to the side plates and motor casing through the bearings, and also the driving shaft can be supported at both axial ends to the side plates and gear casing through the bearings. Since the overload prevention device is provided between the axial ends of the shafts supported at both ends respectively, the shafts can be restrained from deflection and easy to align, thereby enabling the problem in the conventional example of causing deflection to be solved.

In the case where the receiving member and holding member having therebetween a juncture, such as splines, are provided, the casing member and the adjusting member screwable therewith are provided, and the receiving member, holding member, friction member and elastic member are housed in the casing member and held by threadedly engaging the adjusting member with the casing member,so as to form the overload prevention unit, the unit of the above-mentioned construction is interposed between the side plates when assembled and the motor shaft and driving shaft are merely fitted into the juncture for the receiving member and holding member, whereby the overload prevention device can be built-in. Hence, the built-in work can be easy to that extent and the friction plate is housed in the casing member, so as to be less damaged by an external force and less affected by rain water or dust.

Also, in the case where the holding member is formed of the sleeve and flange, a holder is supported to the sleeve, the friction member is interposed between the holder and the sleeve, and the elastic member is interposed between the holder and the load setting and adjusting member; torque transmitting portions can increase in number and a biasing force of the elastic member can be transmitted on an average, whereby the slip load is easy to accurately set and a coil spring is usable as the elastic member.

Furthermore, in the case where the receiving member having the juncture and cylindrical housing and the holding member having the juncture, shaft portion and larger diameter portion, are provided so as to screw a load setting and adjusting member with the shaft portion of the holding member, and the friction plate and elastic member are housed in the cylindrical housing of the receiving member, and the adjusting member is threadedly engaged with the shaft portion so as to hold the holding member to the receiving member, thereby Forming the overload prevention unit; when the operational effect is obtained by the aforesaid unitization and also a unidirectional rotation transmission mechanism is provided between the motor shaft and the driving shaft, that is, when the mechanical brake is used as the above-mentioned brake, there is no fear that the brake is excessively tightened and the overload prevention device slips not to lower the hoisted load. Hence, the load lowering is ensured. In brief, when the mechanical brake is used as the above-mentioned brake and is too tightened to make the friction transmitting force of the brake larger than that (a slip load), the unidirectional rotation transmission mechanism can easily be provided in order to eliminate the defect that the overload prevention device slips not to lower the load during the lowering the hoisted load. In other words, in a simple construction of only one unidirectional rotation transmission mechanism is provided between the receiving member and the holing member, the motor shaft and driving shaft are integrally rotatable during the load lowering by the reverse rotation of the motor, thereby eliminating with ease the defect that the load lowering is impossible.

These and other objects of the invention will become more apparent in the detailed description and examples which follow.

DETAILED DESCRIPTION OF THE INVENTION

Figure 2:
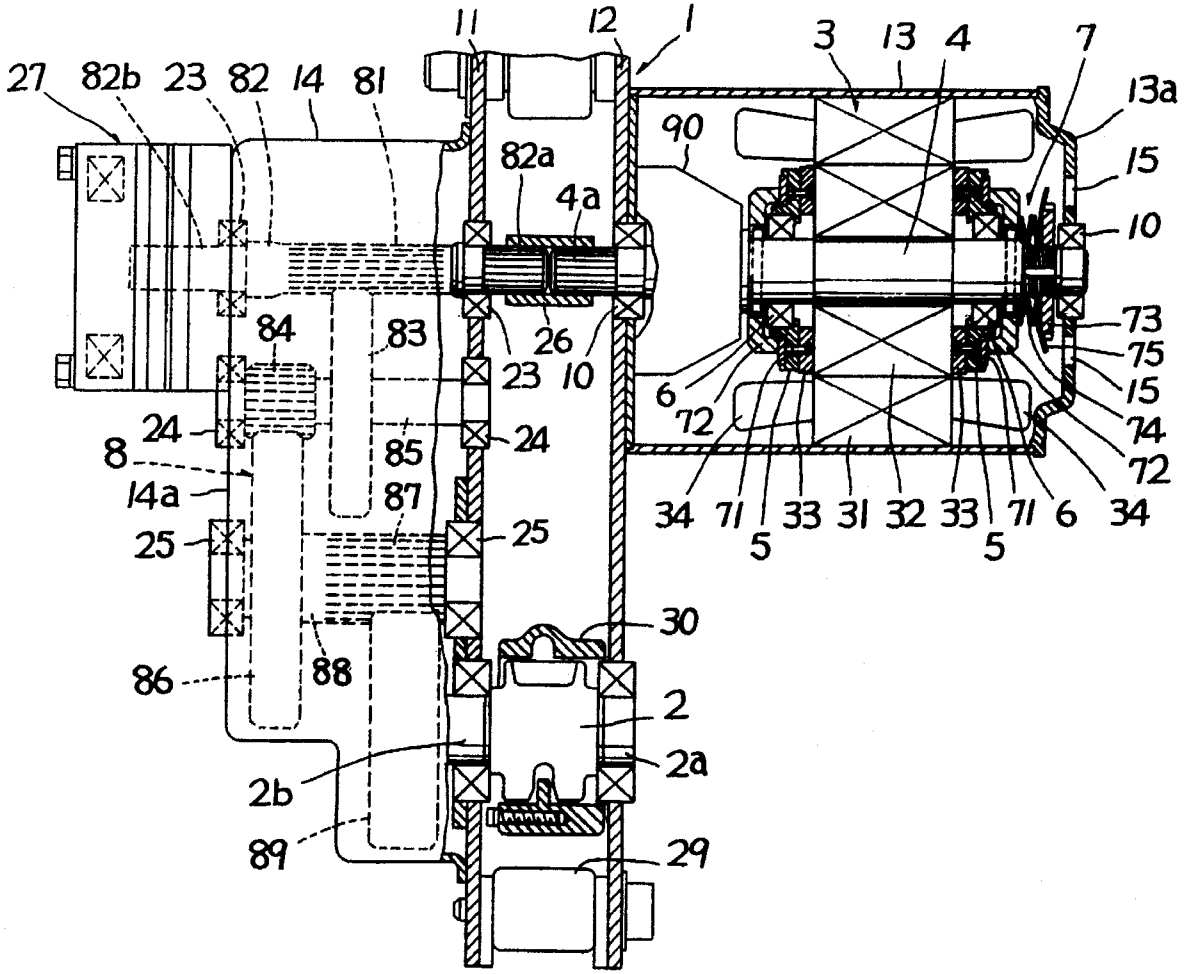
FIG. 2 is a partially sectional view of the same.

An electric hoist and traction apparatus shown in FIG. 2 is provided with a chain block body 1 comprising a pair of side plates 11 and 12 opposite to each other and spaced at a predetermined interval and a motor casing 13 and a gear casing 14 mounted at each side of the body on side plates 11 and 12, so that a sheave shaft 2*a* having a load sheave 2 for hoisting or hauling a load is rotatably supported between the side plates 11and 12 of the chain block body 1, and an upper hook (not shown)is mounted above between the side plates 11 and 12.

In the motor casing 13 is housed a motor 3 having a stator 31 fixed to the rotor casing 13 and a rotor 32 rotatable in the stator 31, a motor shaft 4 held to the center of the rotor 32 is rotatably supported at both axial ends of the shaft 4 to the side plate 12 and a side plate 13*a* of the motor casing 13 through a pair of bearings 10, and the motor shaft 4 enters at one axial end 4*a* into between the side plates 11 and 12. In addition, the motor 3 uses a capacitor start type motor having a suitable starting capacitor.

Figure 1:
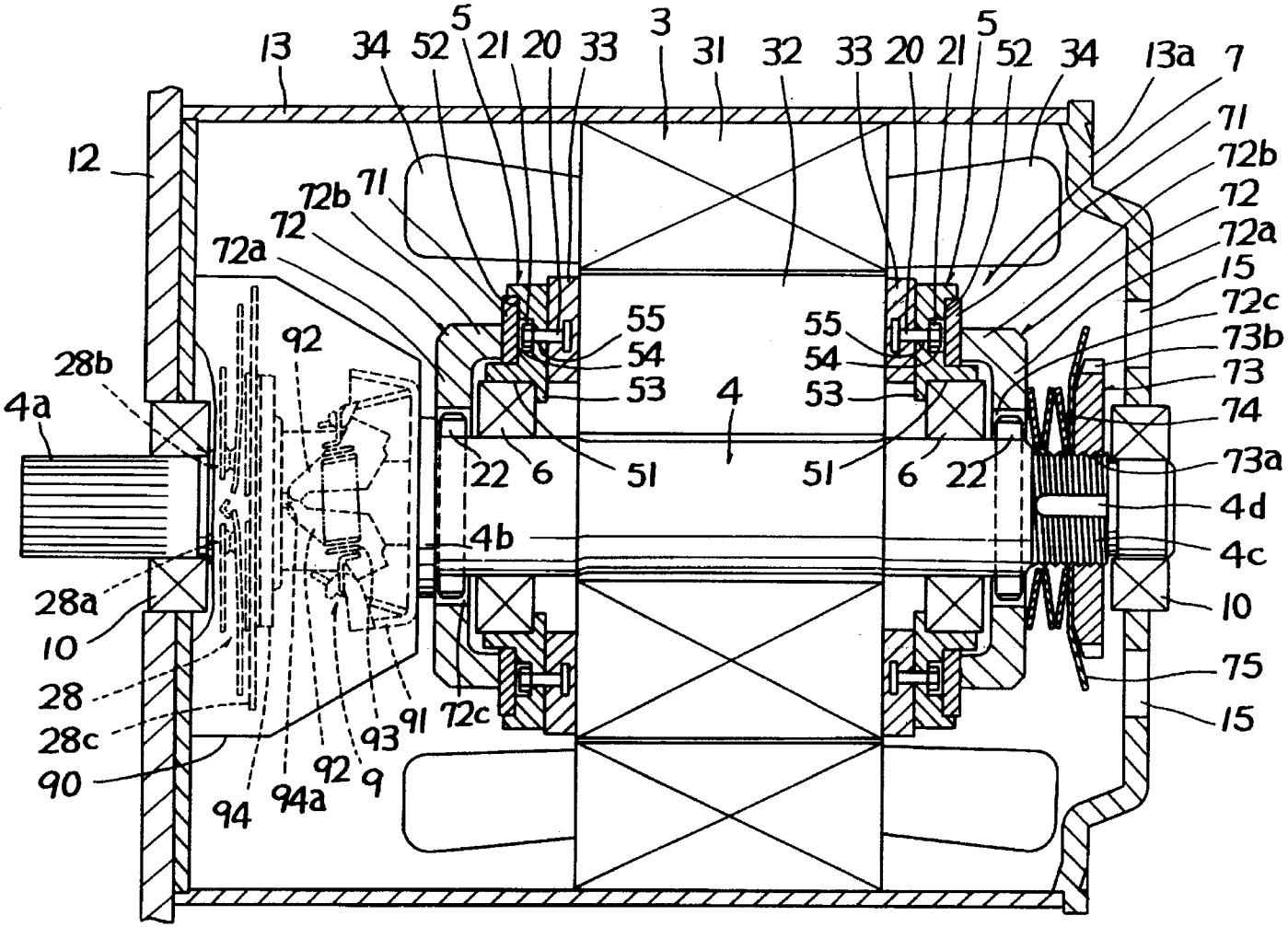
FIG. 1 is an enlarged longitudinally sectional view of a first embodiment of a hoist and traction apparatus of the present invention, showing a principal portion thereof only.

In the embodiment of the present invention shown in FIG. 1, ring-like-shaped hubs 5 each having a bearing holding portion 51 and a friction receiving surface 52 are fixed through a plurality of screw bolts 20 and nuts 21 screwable therewith to the end faces of the end rings 33 provided at both axial sides of the rotor 32. In addition, each screw bolt 20 is embedded at the head thereof into the end ring 33 so as to be integral therewith.

Figure 3:
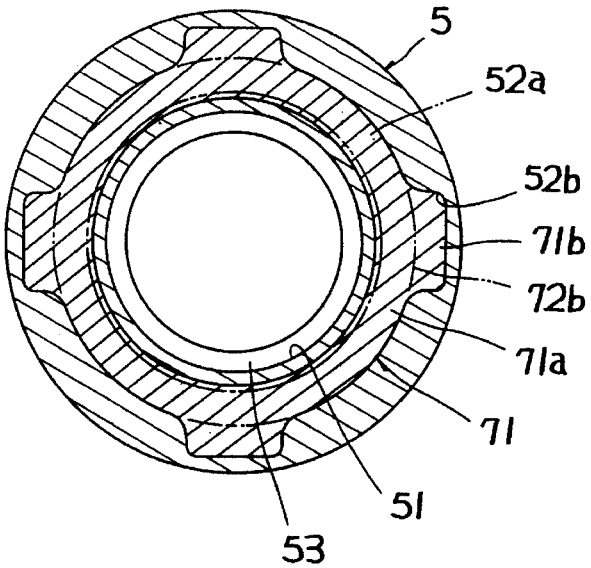
FIG. 3 is a longitudinally sectional view of a friction plate portion in FIG. 1, from which a bearing and a driving shaft are omitted.
Figure 4:
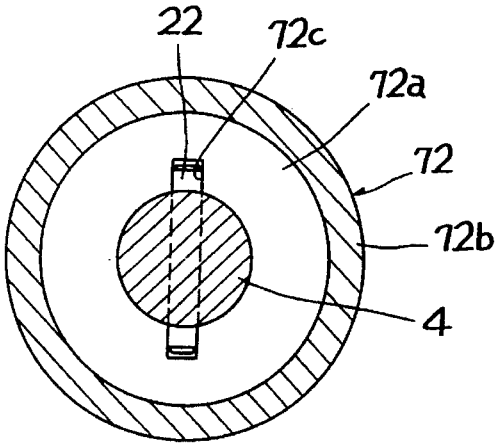
FIG. 4 is longitudinally sectional side view of a biasing member in FIG. 1.

Each hub 5,as shown in FIG. 1, is provided at the ring-like inner periphery thereof with the bearing holding portion 51 and an internal flange 53, each bearing 6 is fitted into the bearing holding member 51 and held thereto, the bearing 6 is fitted at the inner periphery thereof onto the outer periphery of the driving shaft 4, the rotor 32 is relative-rotatably supported thereto through the bearing 6, at the outer side-surface of the hub 5, as shown in FIG. 3, are provided the friction receiving surface 52 comprising an annular recess 52*a* and a plurality of locking portions 52*b* extending radially outwardly from the outer periphery of the recess 52*a* and at an intermediate portion of the friction receiving surface 52, as shown in FIG. 1, are provided a plurality of sockets 54 recessed into the friction receiving surface 52 and for receiving the nuts 21 respectively, and through bores perforating the sockets 54 respectively.

Between the friction receiving surface 52 of the hub 5 provided at the outside of motor 3, that is, at the reverse side to the side plate (at the right side in FIG. 1) and the driving shaft 4 are provided a friction plate 71 not rotatably relative to the friction receiving surface 52, a biasing member 72 for biasing the friction plate 71 to the friction receiving surface 52, a load setting and adjusting member 73 for moving the biasing member 72 to set a slip load, an elastic member 74 interposed between the adjusting member 73 and the biasing member 72; and between the friction receiving surface 52 of the hub 5 provided at a side of the side plate with respect to the motor 3 (at the left side in FIG. 1) and the driving shaft 4 are provided a friction plate 71 and a biasing member 72 the same as the reverse side to the side plate, thereby constituting an overload prevention device 7.

The friction plates 71 provided at the side-plate side and the reverse side to the side plate, as shown in FIG. 3, each have a ring 71*a* and a plurality of swollen portions 71*b* extending radially outwardly from the outer periphery of the ring 71*a* and are not-relative-rotatably supported to the friction receiving surface 52 of the hub 5.

The biasing members 72 provided at the side-plate side and the reverse side thereto each comprise a ring 72*a* and a cylindrical portion 72*b* axially projecting from the outer periphery thereof toward the hub 5, the ring 72*a* being not-relative-rotatably but axially movably to the driving shaft 4 so that the end face of the cylindrical portion 72*b* abuts against the friction plate. In addition, at biasing member supporting portions at both the axial ends of the driving shaft 4 are provided locking pins 22 radially perforating the driving shaft 4. At the inner periphery of each ring 72*a* is provided an engaging groove 72*c* engageable with the projecting end of the lock pin 22, so that each biasing member 72 is prevented from rotation with respect to the driving shaft 4 and to be axially movable relative to it. Besides this,a lock mechanism of spline construction may be provided between the inner periphery of the ring 72*a* and the driving shaft 4. The biasing member 72 provided at the side-plate side with respect to the rotor 3 engages with a larger diameter portion 4*b* projecting from the outer periphery of the driving shaft 4 so as to be restrained from movement toward the side plate 12.

Figure 5:
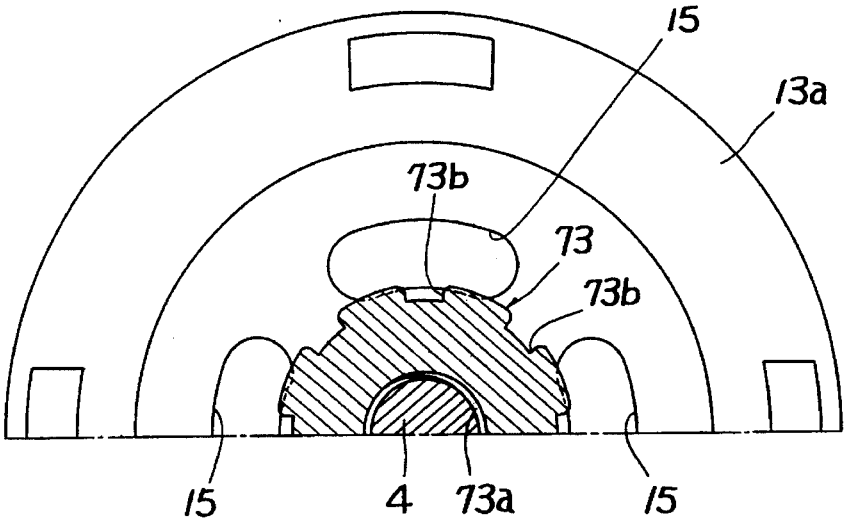
FIG. 5 is a longitudinally sectional side view of a load setting and adjusting member in part.

The adjusting member 73 is provided only at the reverse side to the side plate, which, as shown in FIG. 5, is ring-like-shaped and has a threaded bore 73*a* at the inner periphery and a rotary operation portions of many projections and recesses at the outer periphery, so that the threaded bore 73*a* is threadedly engaged with an external thread 4*c* provided on the outer periphery of the driving shaft 4, so that the adjusting member 73 rotates to axially move the biasing member 72.

The elastic member 74 is provided only at the reverse side to the side plate, which uses three disc springs in FIG. 1, but the number thereof is particularly limited. Also, other than the disc spring, for example, a coil spring may be used.

On the other hand, at a side plate 13*a* of the motor casing 13, as shown in FIGS. 1 and 5, a plurality of operating slots 15 extending in the rotation direction of the adjusting member 73 are provided at the portion opposite to the rotary operation portions 73*b* of the adjusting member 73 and an operating jig having an engaging portion engageable with the rotary operation portion 73*b* is inserted from the exterior of motor casing 13 into the operating slots 15 so as to rotatably operate the adjusting member 73.

Also, as shown in FIG. 2, in the gear casing 14 is housed a reduction gear mechanism 8 for reducing the rotation speed of the driving shaft 4 to transmit it to the load sheave 2. The reduction gear mechanism 8 comprises a driving shaft 82 having a first gear 81 and disposed on the same line as the driving shaft 4, a first intermediate shaft 85 having a second gear 83 engageable with the first gear 81 and a third gear 84 provided adjacent to the second gear 83, a second intermediate shaft 88 having a fourth gear 86 engageable with the third gear 84 and a fifth rear 87 provided adjacent to the fourth gear 86, and a sixth gear 89 engageable with the fifth gear 87, so that the driving shaft 82 and intermediate shafts 85 and 88 are rotatably supported between the side plate 11 and a side plate 14*a* of the gear casing 14 through pairs of bearings 23, 24, and 25, the one axial end 2*b* of the sheave shaft 2*a* is positioned in the gear casing 14 and the sixth gear 89 is provided at the one axial end 2*b*, one axial end 82*a* of the driving shaft 82 is entered into between the side plates 11 and 12 so as to abut against the one axial end 4*a* of the motor shaft 4, and a transmitting cylinder 26 is not-relative-rotatably fitted between the axial ends 4*a* and 82*a* so as to connect the driving shaft 82 and 4. Also,the other axial end 82*b* of the driving shaft 82 projects outwardly from the gear casing 14,and between the other axial end 82*b* and the gear casing 14 is provided an electromagnetic brake 27 which operates when the motor 3 stops and exerts the braking action on the rotation of the driving shaft 82.

In the embodiment shown in FIGS. 1 and 2, a governor switch is provided in the motor casing 13 and between the motor 3 and the side plate 12. The governor switch comprises a support 91 mounted on the motor shaft 4 and rotatable integrally therewith, a pair of weights swingably supported to the support 91 and subjected to a centrifugal force caused by the rotation of motor shaft 4 so as to swing radially outwardly at the utmost end, a governor 9 having a spring 93 interposed between the weights 92 to bias the weights 92 radially inwardly against the centrifugal force and an operating disc 94 having an association portion 94*a* in association with the swinging motion of the weights 92 and to move in reciprocation axially of the motor shaft 4 and a switching unit 28 following the operation of the governor 9 so as to turn on and off a starting capacitor for the motor 3. Hence, the governor 9 is operated corresponding to the driving and stopping operations of the motor 3 so that the switching unit 28 is operated. The switching unit 28 comprises a hoisting side switch 28*a* which is normally in the "on" position; a lowering side switch 28*b* which is normally in the "on" position; and a switch control panel 28*c*. The switch control panel 28*c* is movable responsive to a movement of the operating disc 94 of the governor 9, and thereby, when the hoisting operation is made, the lowering side switch 28*b* is maintained in the "on" operation with the hoisting side switch 28*a* turned off, while on the other hand, when a lowering operation is made, the hoisting side switch 28*a* is maintained in the "on" operation with the lowering side switch 28*b* turned off. Thus, when the drive of the motor is switched at some midpoint in the lowering operation to the hoisting operation or at some midpoint in the hoisting operation to the lowering operation, the starting capacitor is immediately operated in response to it.

In FIGS. 1 and 2, reference numeral 75 designates a ring-like-shaped lock plate supported to the external thread 4*c* at the motor 4 and for preventing the adjusting member 73 from loosening with respect thereto, so that at the inner periphery of the lock plate 75 is provided an engaging projection engageable with an axial groove 4*d* formed at the external thread 4*c*, thereby preventing the lock plate 75 from rotating with respect to the motor shaft 4 and enabling the same to be axially movable only. In addition, instead of the lock plate 75, a lock nut may screw with the external thread 4*c* so as to prevent the adjusting member 73 from loosening. Also, in FIG. 1, reference numeral 90 designates a cover for the governor 9 and switch 28,29 designates a chain guide having a chain passage guiding a chain engaging with the load sheave 2 and mounted between the side plates 11 and 12 and below the load sheave 2, and 30 designates a chain holder for preventing the chain from escaping from the load sheave 2.

Next, explanation will be given on operation of the first embodiment constructed as the above-mentioned.

When the load is hoisted, the motor 3 is driven, whereby the rotation of rotor 3 is transmitted to the motor shaft 4 through the hub 5, friction plate 71 and biasing member 72, and then transmitted to the load sheave 2 from the motor shaft 4 through the first through the sixth gears, thereby rotating the load sheave 2 to hoist the load.

When the load sheave 2 is subjected to a load larger than the slip load set by the overload prevention device 7 during the load hoisting or hauling, the friction plate 71 and biasing member 72 of the overload prevention device 7 slips therebetween so as not to transmit the rotation of rotor 32 to the motor shaft 4. In addition, when the motor 3 is driven, the electromagnetic brake 27 is shut off from energization and does not operate.

As the above-mentioned, the overload prevention device 7 is provided between the rotor 32 and the motor shaft 4, so that, even in a case where the driving shaft 82, as shown in FIG. 2, is provided with a brake 27 for braking the rotation of driving shaft 82, and the inching operation is frequently performed to change the frictional property of friction plate 71 of the overload prevention device 7 due to, for example, temperature changes, the brake 27 is operable so as to prevent the load from uncontrollably lowering.

Since the rotor 32 of the motor 3 is utilized to mount the hubs 5 to the end ring 33 of the rotor 32 and the overload prevention device 7 is provided between the hub 5 and the motor shaft 4, the overload prevention device 7 can be disposed in the inner space at the coil end of the motor 3 as shown in FIG. 1. Accordingly, the axial length can be reduced in comparison with the conventional example so as to restrain the apparatus from being large-sized. Moreover, the motor shaft 4 can be supported at both axial ends to the side plate 12 and the side plate 13*a* of the motor casing 13, whereby, even when the driving shaft 82 is disposed in the same line as the motor shaft 4, the driving shaft 82 and motor shaft 4 are easy to align, and the problem that the deflection is caused can effectively be solved together with reducing the axial length of the motor shaft 4.

The hubs 5 are mounted to the end rings 33 provided at both the axial ends of rotor 32 and the rotor 32 is rotatably supported to the motor shaft 4 through the bearings 6 interposed between the hubs 5 and motor shaft 4, whereby the bearings 6 can be less affected by a temperature rise during the driving in comparison with the case where the bearing 6 is provided within the rotor 32, so that and the bearing efficiency is made almost constant. Accordingly, it can be avoided that the motor shaft 4 is subjected to rotational resistance larger than the slip load set by the overload prevention device 7. Also, there is no need that the bearing holding unit is provided at the inner periphery of the rotor 32, whereby the rotor 32 can be improved in workability.

Even when the governor 9 is provided at the motor shaft 4, the governor 9 in part can be disposed at the inner space at the coil end 34 of the motor 3, whereby the axial length can be reduced while the governor 9 is provided.

In addition, in the above-mentioned embodiment, the elastic member 74 and load selling and adjusting member 73 are provided only at the reverse side to the side plate with respect to the rotor 32, but both the members 74 and 73 may be provided at both the axial sides of the rotor 32 or only at a side of the side plate 12 of the rotor 32. When the adjusting member 73 is provided at a side of the side plate 12 with respect to the rotor 32, for example, at the outer periphery of the motor casing 13 and at the portion opposite to the rotary operation portion 73*b* of the adjusting member 73, are provided the operating slots 15.

Figure 6:
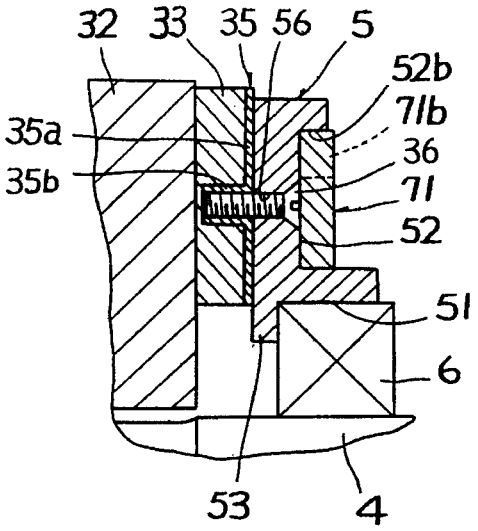
FIG. 6 is a partially sectional view showing another example of fixing a hub to an end ring.
Figure 8:
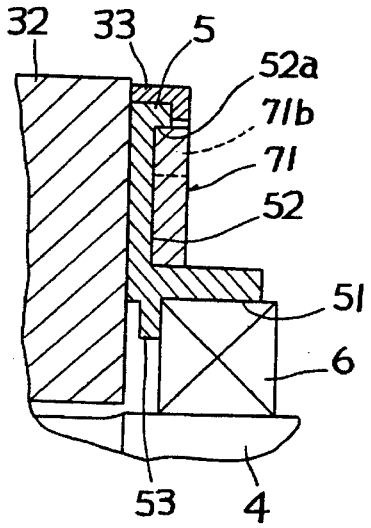
FIG. 8 is a partially sectional view showing yet another example of fixing the hub to the end ring.

In the above-mentioned embodiment, the bolt 20 is embedded in each ring 33 of the rotor 32 and the nut 21 is screwably tightened to the boil 29 so as to fix the hub 5 to each end ring 33, but the hub 5 may be fixed thereto as shown in FIGS. 6 and 8.

In the embodiment shown in FIG. 6, a mounting member 35 is molded and embedded in the end ring 33 to be integrally fixed therein. The mounting member 35 comprises an annular plate 35*a* opposite to the end face of the end ring 33 and a plurality of threaded cylinders 35*b* with internal threads which project from the annular plate 35*a* in the thickness direction. The friction receiving surface 52 of the hub 5 is provided with a through bore 56 having a socket for receiving therein a head of a screw bolt 36. The screw bolt 36 is screwed into the threaded cylinder 35*b* from the through bore 56 to fix the hub 5 to the end ring 33. Instead of the mounting member 35, nuts may be embedded into the end ring 33, into which nuts the screw bolts 36 are screwed to fix the hub 5 to the end ring 33. In addition, in the case of this embodiment, a nut is used instead of the mounting member 35 and embedded into the end ring 33, so that the screw bolt 36 may be tightened to the nut, thereby fixing the hub 5 to the end ring 33.

Figure 7:
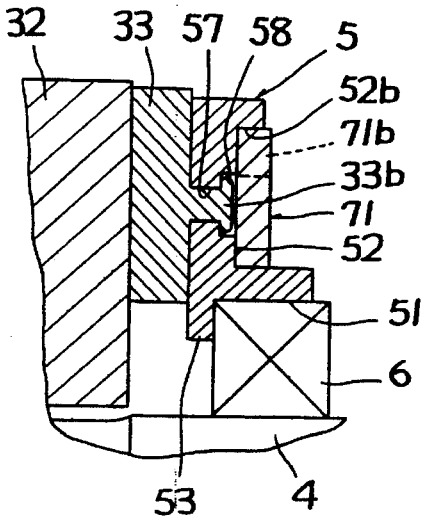
FIG. 7 is a partially sectional view showing still another example of fixing the hub to the end ring.

In FIG. 7, at the end face of the end ring 33 are disposed a plurality of fitting projections 33*b* circumferentially projecting and spaced at the predetermined intervals, at the friction receiving surface 52 of the hub 5 are provided a fitting bore 57 for receiving therein the fitting projection 33*b* and a socket 58 for receiving a caulked position of the utmost end of fitting projection 36 when caulked, and the fitting bore 57 is fitted onto the fitting projection 33*b*, to caulk the fitting projection 33*b*, thereby fixing the hub 5 to the end ring 33.

In FIG. 8, the hub 5 is embedded to be molded into the end ring 33 and integrally fixed thereto.

Also, in the above-mentioned embodiment, the electromagnetic brake is used. Besides this, a mechanical brake may be used. Also, the electromagnetic brake 27 and mechanical brake, other than is provided at the driving shaft 82 as shown in FIG. 2, may be provided at the motor shaft 4 or the intermediate shaft of a the reduction gear mechanism.

Next, explanation will be given on a second embodiment shown in FIG. 9.

The second embodiment is fundamentally the same as that shown in FIGS. 1 and 2 and is different therefrom in that the hub 5 is omitted and the bearing holding unit 51 and friction receiving surface 52 are provided at the end rings 33 at both the axial ends of the rotor 32.

Figure 9:
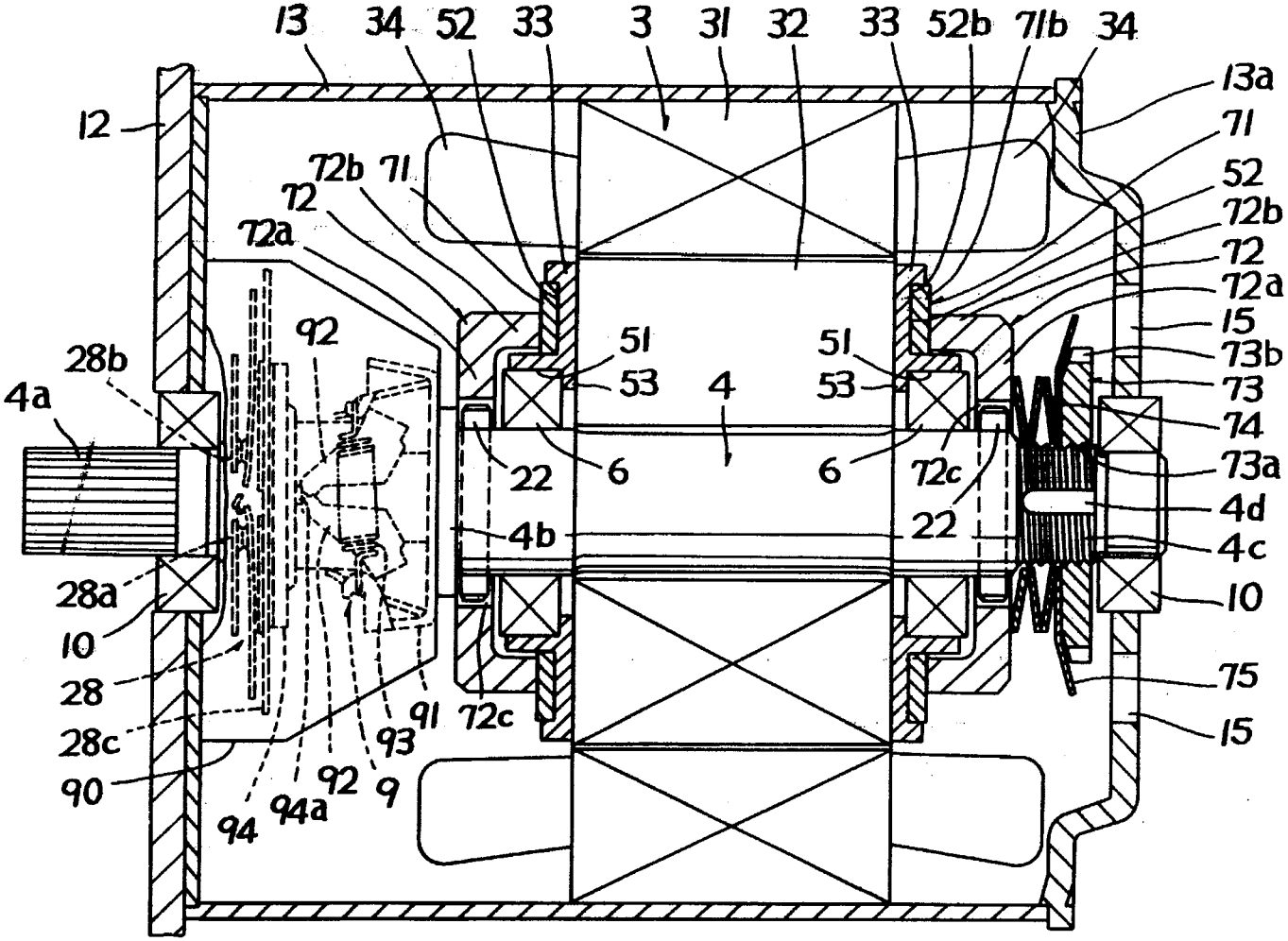
FIG. 9 is an enlarged longitudinally sectional view of a second embodiment of the hoist and traction apparatus of the present invention, showing a principal portion thereof only.

In detail, in FIG. 9, at the inner periphery of each end ring 33 are provided the bearing holding portion 51 and the inner flange 53,each bearing 6 is fitted and held to the bearing holding portions 51, the inner periphery of each bearing 6 is fitted onto the outer periphery of the motor shaft 4, the rotor 32 is relative-rotatably supported to the motor shaft 4 through the bearings 6, and at the outer side surface of each ring 33 is provided the friction receiving surface 52 comprising an annular recess 52*a* and a plurality of lock portion 52*b* radially outwardly extending from the outer periphery of the recess 52*a*. In addition, the common parts are designated by the same reference numerals as the embodiment in FIG. 1.

This construction need not use the hub 5 as shown in FIGS. 1 and 2, the axial length can be reduced more than that in FIGS. 1 and 2, and the apparatus can further be restrained from being large-sized.

Next, explanation will be given on a third embodiment shown in FIG. 10 and 11.

The third embodiment is provided with an overload prevention device 7A between the axial end 82*a* of the driving shaft 82 and the axial end 4*a* of the motor shaft 4 entering into between the side plates 11 and 12 to abut thereagainst.

Figure 11:
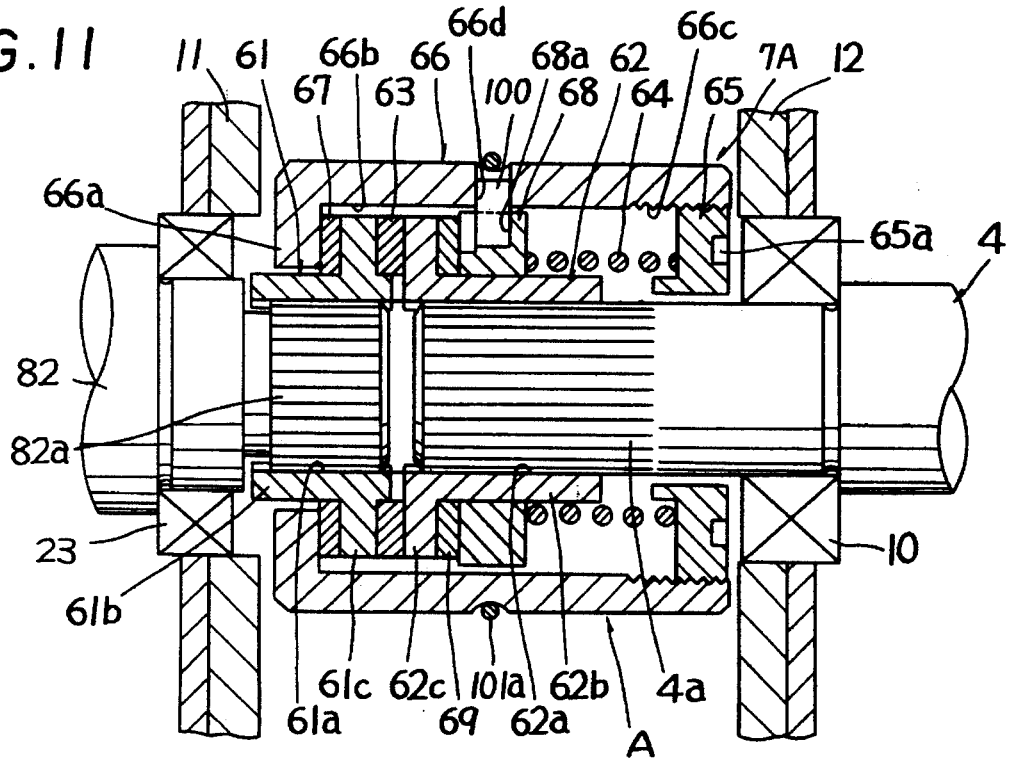
FIG. 11 is an enlarged sectional view of the principal portion of the same.

The overload prevention device 7A, as shown in FIG. 11, comprises a cylindrical receiving member 61 not-relative rotatably coupled with the one axial end 82*a* of the driving shaft 82, a cylindrical holding member 62 not-relative-rotatably coupled with the one axial end 4*a* of the motor shaft 4, a ring-like-shaped friction member 63 interposed between the opposite surfaces of the receiving member 61 and holding member 62, an elastic member 64 comprising a coil spring for biasing the holding member 62 toward the receiving member 61, and a load setting and adjusting member 65 for adjusting the biasing force of the elastic member.

The receiving member 61 and holding member 62 are provided with sleeves 61*b* and 62*b* having at the inner peripheries junctures 61*a* and 62*a* comprising splines and the external flanges 61*c* and 62*c* radially outwardly projecting from one ends of the sleeves 61 and 62 respectively, the juncture 61*a* of the receiving member 61 being spline-fitted onto the outer periphery of the axial end 82*a*, the juncture 62*a* of the holding member 62 being spline-fitted onto the outer periphery of the driving shaft 4 in relation of being axially movable,and the friction member 63 being interposed between the flanges 61*c* and 62*c*.

Meanwhile, a cylindrical casing member 66 is formed which has at one axial end a receiving portion 66*a* opposite to the flange 61*c*, at the intermediate portion a cavity 66*b* for receiving therein the receiving member 61 and holding member 62 so as to be holdable, and at the other axial end internal thread. The receiving member 61, holding member 62, friction member 63 and elastic member 64 are housed in the cavity 66*b* of the casing member 66, between the receiving portion 66*a* and the flange 61*c* is interposed a friction plate 67,between the flange 62*c* and the elastic member 64 is interposed a ring-like-shaped holder 68 not rotatable but axially movable with respect to the sleeve 62*b*, between the holder 68 and the flange 62*c* is interposed a friction member 69, and the adjusting member 65 screws with the internal thread 68*c*, so that the receiving member 61, holding member 62,friction members 63, 67 and 69, elastic member 64 and holder 68 are held in the casing member 66, thereby forming an overload prevention unit A.

At the inner periphery of the holder 68 or the outer periphery of the sleeve 62*b* (FIG. 11) is provided an axial projection, and at the other is provided an axial recess engageable with the axial projection so as to axially movably support the holder 68 onto the outer periphery of the sleeve 62*b*. At the outer periphery of the holder 68 are provided a plurality of locking recesses 68*a* circumferentially disposed and spaced at the predetermined intervals, and at the opposite portion of the casing member 66 to the holder 68 are bored a plurality of pin holes 66*d* circumferentially disposed and spaced at the predetermined intervals, and a lock pin 100 prevented by a snap ring 101*a* from escaping from the casing member 66 is inserted into the pin hole 66*d* and locking recess 68*a*, thereby preventing the holder 68 from rotation with respect to the holding member 62.

Figure 12:
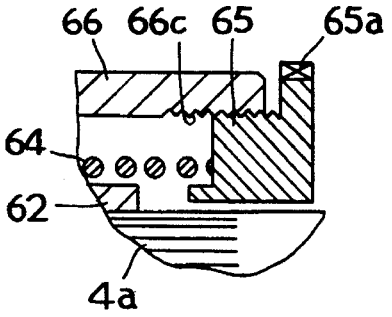
FIG. 12 is a partially sectional view of another example of a load setting and adjusting member at an overload prevention device in FIG. 11, FIG. 13 a partially sectional view of still another example of the same.
Figure 13:
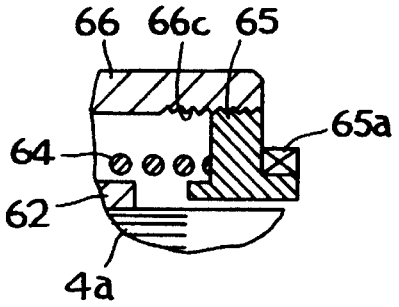
Figure 14:
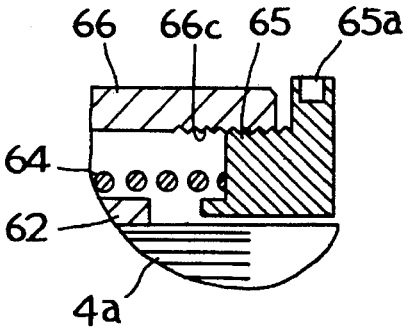
FIG. 14 is a partially sectional view of yet another example of the same.

On the other hand, at the outside surface of the adjusting member 65 is provided a recessed rotary operation member 65*a*. Besides this, as shown in FIG. 12, at the outer periphery of the adjusting member 65 may be provided an annular projection projecting radially outwardly beyond the end face of the casing member 66 and a square or hexagonal operating portion 65*a* may be provided at the outer periphery of the projecting portion. Also, as shown in FIG. 13, at the inner periphery of the adjusting member 65 is provided an annular projection axially outwardly projecting beyond the end edge of the casing member 66 so that square or hexagonal rotary operating portion 65*a* may be provided at the outer periphery of the projection. As shown in FIG. 14, at the outer periphery is provided an annular projection radially outwardly projecting beyond the edge of the casing member 66 so that a plurality of rotary operating portions 65*a* of hexagonal bores circumferentially bored and spaced at predetermined intervals. Also, the adjusting member 65 may be formed in a double cylindrical shape having a smaller diameter cylindrical portion having a screw thread engageable with the internal thread 66*c* and a larger diameter portion extending radially outwardly from one axial end thereof and bending at the utmost end in the same direction as the smaller diameter portion, so that the rotary operating portion may be provided at the outer periphery of the larger diameter portion.

Next, explanation will be given on the operation of the third embodiment constructed as above-mentioned.

In the third embodiment, since the overload prevention device 7A is provided between the motor shaft 4 and the driving shaft 82 as above-mentioned, the motor 3 is not formed in particular specification as the first and second embodiments, but can use a standard product. Even when the brake 27 for braking the rotation of the driving shaft 82 is provided as shown in FIG. 10 and the inching operation is frequently performed as the same as the first and second embodiments so as to change properties of the friction members 63 and 69 at the overload prevention device 7A due to, for example, temperature changes, the brake 23 is operable, thereby enabling the load to be prevented from uncontrollable lowering.

Also, since the motor shaft 4 and driving shaft 82 abut against each other between the side plates 11 and 12 and the overload prevention device 7A is provided between the motor shaft 4 and the driving shaft 82, the overload prevention device 7A can be assembled by effectively utilizing the space between the side plates 11 and 12 supporting the load sheave 2. Accordingly, while using the overload prevention device 7A, the axial length is restricted, whereby the problem in that the motor casing and gear casing become large-sized and the apparatus becomes larger as a whole can be solved. Moreover, the motor shaft 4, which abuts against the driving shaft 82 between the side plate 1 and 12, can be supported at both the axial ends to the side plates 12 and 13*a* of the motor casing 13 through the bearing 10. Also, the driving shaft 82 can be supported at both axial ends thereof to the side plate 11 and gear casing 14 through the bearing 23. Since the overload prevention device 7A is provided between the axial ends of the motor shaft 4 and driving shaft 82 thus supported at both the axial ends respectively, in spite of the fact that the driving shaft 82 is disposed in the same axis as the motor shaft 4, the shafts 4 and 82 can be restrained from deflection, and alignment is easy to perform, thereby enabling the above-mentioned defect caused by the deflection to be eliminated.

Also, the overload prevention device 7A, which is provided between the side plates 11 an 12, and is not housed in the motor casing 13, can be less affected by heat of the motor 3, whereby the problem that the torque transmitting characteristic of the overload prevention device 7A changes can be solved.

Even when the governor switch is provided on the motor shaft 4 as the same as FIG. 1, since part of the governor switch can be disposed in the inner space at the coil end 33, the axial length can be reduced while the governor switch is provided.

Also, the overload prevention device 7A is unitized by holding within the casing member 66 the receiving member 61, holding member 62,friction members 63, 67 and 69, elastic member 64 and load setting and adjusting member 65, so that, when the side plates 11 and 12 are assembled, the overload prevention unit A is interposed between the side plates 11 and 12, one axial end 4*a* of the motor shaft 4 is fitted into the puncture 62*a* of the holding member 62,and the one axial end 82*a* of the driving shaft 82 is merely fitted onto the juncture 61*a* of the receiving member 61, whereby the overload prevention device 7A can be assembled to facilitate the assembly work to that extent. Also, the friction members 63, 67 and 69, which are housed in the casing member 66, can be less damaged by the external force and less affected by rain water or dust.

In the case where the holder 68 is supported to the sleeve 62*b* of the holding member 62, the friction member 69 is interposed between the holder 68 and the flange 62*c*, and the elastic member 64 is interposed between the holder 68 and the load setting and adjusting member 65; torque transmission portions can increase in number and the biasing force of the elastic member 64 is transmitted to the friction member 69 on the average, whereby the slip load is easy to accurately set and a coil spring can be used as the elastic member 64.

Figure 15:
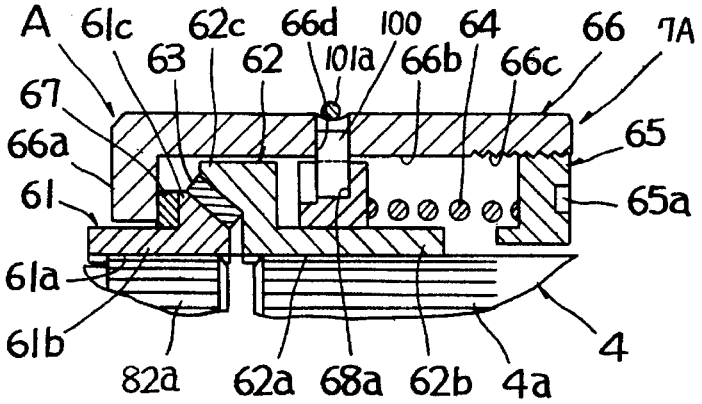
FIG. 15 is a partially sectional view of a modified embodiment of the overload prevention device in FIG. 11.

In addition, in the embodiment shown in FIG. 11, the flanges 61*c* and 62*c* provided at the receiving member 61 and holding member 62 are provided perpendicularly to the axis, but the flanges 61*c* and 62*c*, as shown in FIG. 15, may be slanted with respect to the axis and the friction member 63 may be interposed between the slanted flanges 61 and 62*c*, in which a slip load larger than that in FIG. 11 is easy to set.

Next, explanation will be given on a fourth embodiment shown in FIG. 16.

Figure 16:
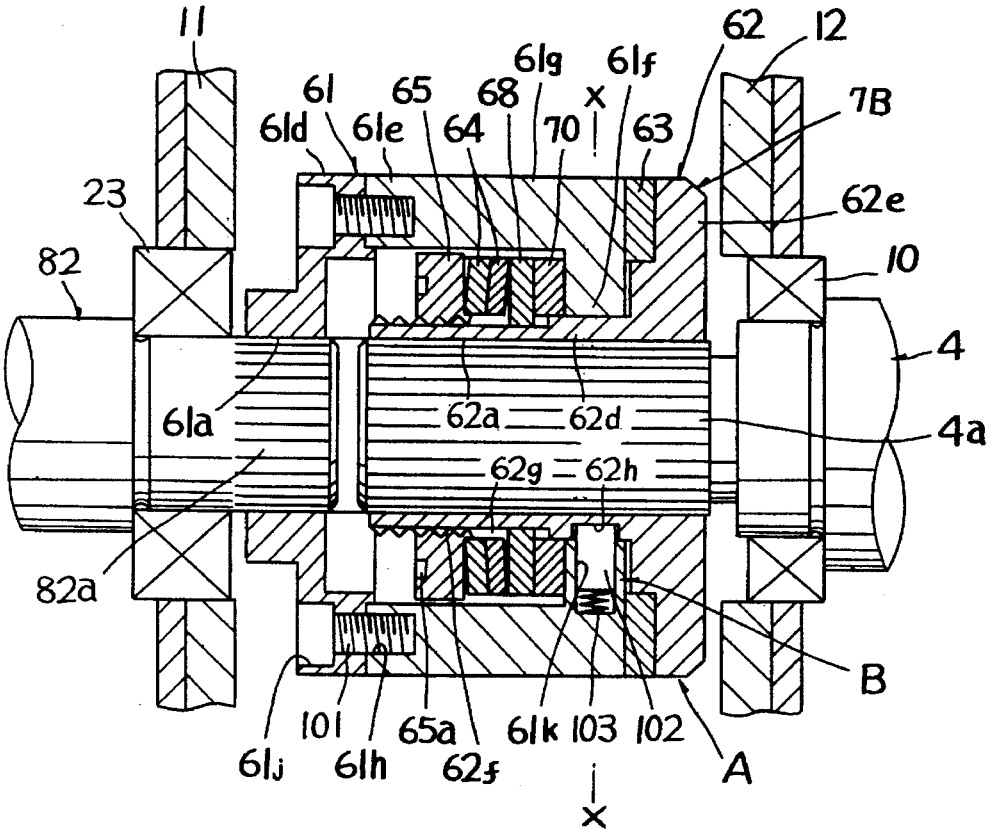
FIG. 16 is an enlarged sectional view of a fourth embodiment of the present invention, corresponding to FIG. 10.

In addition, in FIG. 16, the parts in common with the embodiment in FIG. 11 are designated by the same reference numerals.

An overload prevention device 7B of the fourth embodiment is provided with; a receiving member 61 comprising a ring-like-shaped coupler 61*d* having a juncture 61*a* coupled with the one axial end of the driving shaft 82; a receiving member 61 comprising a cylindrical portion 61*e* connecting with the coupler 61*d* and a cylindrical housing 61*g* having receiving portion 61*f* projecting radially inwardly from the utmost end of the cylindrical portion 61*e*; and a holding member having a cylindrical shaft portion 62 having at the inner periphery a juncture 62*a* coupling with the one axial end 4*a* of the motor shaft 4 and capable of being housed in the cylindrical housing 61*g* and a larger diameter portion 62*e* radially outwardly projecting from the one axial end of the shaft portion 62*d*. A ring-like-shaped load setting and adjusting member 65 screws with the shaft portion 62*d* of holding member 62, a ring-like-shaped friction member 70 and an elastic member 64 comprising disc springs are interposed between the adjusting member 65 and the receiving portion 61*f*, and a ring-like-shaped friction plate 63 is interposed between the receiving portion 61*f* and a larger diameter portion 62*e* of the holding member 62, so that the adjusting member 65 is threadedly engaged with the shaft portion 62*d* to hold the holding member 62 to the receiving member 61, thereby forming an overload preventing unit A.

The receiving member 61 is provided at one end of the cylindrical housing 61*g* with a plurality of threaded bores 61*h*, the coupler 61*d* is provided with through-bores 61*j* corresponding to the threaded bores 61*h*, and screw bolts 101 perforating the through-bores 61, are screwably tightened to the threaded bores 61*h*, thereby connecting the cylindrical housing 61*g* with the coupler 61*d*.

The shaft portion 62*d* of the holding member 62 is provided at the outer periphery of the other axial end thereof with external thread 62*f* screwable with the adjusting member 65 and a lock groove 62*g* axially extending, and between the lock groove 62*g* and the larger diameter portion 62*c* is provided a unidirectional transmission unit 62*h*.

A ring-like-shaped holder 68 is supported on the shaft portion 62*d* between the friction member 70 and the elastic member 64, and the engaging projection projecting from the inner periphery of the holder 68 engages with the lock groove 62*g*, thereby preventing the holder 68 from rotation with respect to the shaft portion 62*d*. Meanwhile, a pin hole 61*k* is provided at the inner periphery of the receiving portion 61*f* at the cylindrical housing 61*g*, and into the pin hole 61*k* are inserted a transmission pin 102 engageable with the unidirectional rotation transmission unit 62*h* and a spring 103 for always biasing the transmitting pin 102 toward the shaft portion 62*d*, so that a reverse torque of the motor shaft 4 is adapted to be transmitted to the receiving member 61 through the unidirectional rotation transmission mechanism B.

Figure 10:
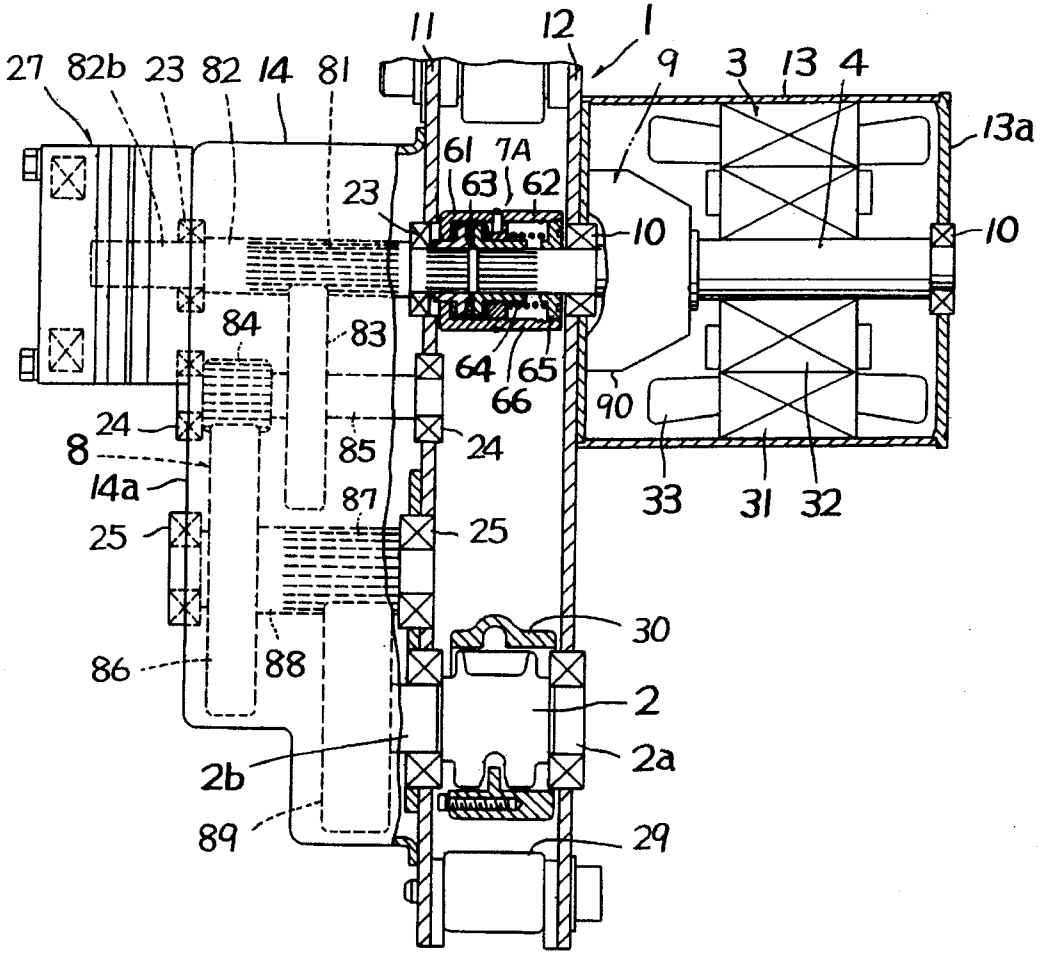
FIG. 10 is a partially sectional view showing a third embodiment of the same.
Figure 17:
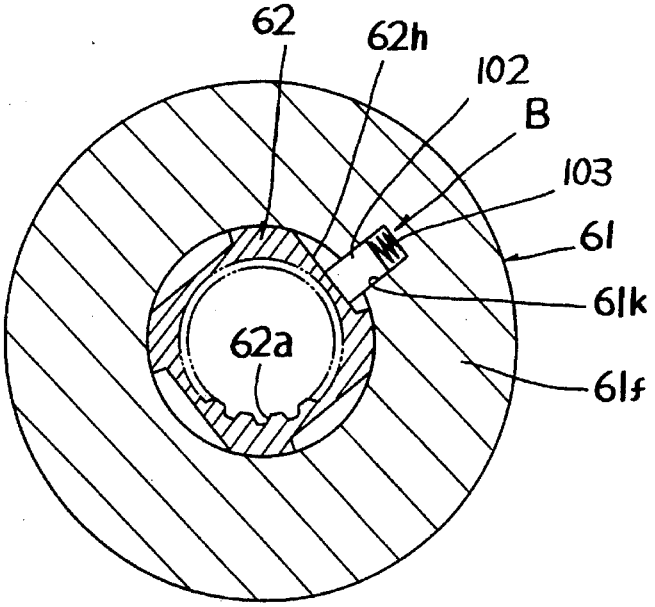
FIG. 17 is a sectional view taken on the line X—X in FIG. 16, from which a motor shaft is omitted.
Figure 18:
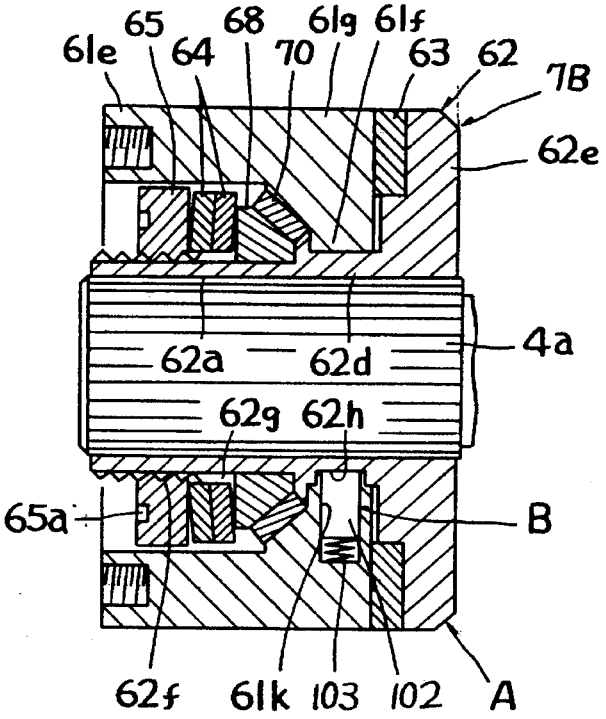
FIG. 18 is a partially omitted sectional view of another modified embodiment of the overload prevention device in FIG. 16.

The fourth embodiment shown in FIGS. 16 and 17 can obtain the same operational effect as the same as the third embodiment shown in FIG. 10 and is provided with the unidirectional rotary transmission mechanism B, whereby even when a mechanical brake is provided at, for example, the first intermediate shaft 85 of the reduction gear mechanism 8, during the lowering the hoisted load, the overload prevention device 6 does not slip, thereby ensuring the load lowering without a failure in lowering. In other words, in a case where the mechanical brake is used as the above-mentioned brake and the mechanical brake is excessively tightened to make a friction transmitting force of the mechanical brake larger than that (slip load) of the overload prevention device 7B, when the motor 3 reversely rotates to lower the hoisted load, the overload prevention device 7B slips so that the reverse torque of motor shaft 4 cannot be transmitted to the driving shaft 82 and the load lowering is impossible. However, the unidirectional rotary transmission mechanism B is provided to enable the motor shaft 4 and driving shaft 82 to integrally rotate during the load lowering by the reverse rotation of motor 3. In addition, the unidirectional rotary transmission mechanism B, which is provided between the receiving portion 61*f* at the receiving member 61 and the shaft portion 62*d* of the holding member, can be formed with ease.

In detail, also in the embodiment shown in FIG. 16, the opposite surfaces of the receiving portion 61*f* of the cylindrical housing 61*g* and the holder 68 may be slanted with respect to the axis and the friction member may be interposed between the opposite surfaces. In this case, the overload prevention device 7B can be set in a larger slip load than that in FIG. 16.

In addition, in the embodiment shown in FIGS. 11 and 16,the receiving member 61 is coupled with the driving shaft 82 and the holding member 62 with the motor shaft 4, but they may be coupled vice versa. Also, receiving member 61 and holding member 62, other than are spline-coupled, may be coupled with each other by use of, for example, a key, in which the coupling means is not particularly limited.

The above-mentioned first through fourth embodiments are typical, and the present invention is not limited to the embodiment and various changes and modifications may be made in the invention without departing from the spirit and scope of the following claims.

What is claimed is:

1. An electric hoist and traction apparatus comprising:

a motor having a stator and a rotor, said rotor having end rings at its axial opposite ends;

a motor shaft to be driven by said rotor;

a load sheave driven in association with said motor shaft;

an overload prevention device forming a driving connection between said motor shaft and said rotor for preventing a further hoisting operation when an overload is applied to said load sheave, said overload prevention device comprising:

(i) hubs secured to said end rings at axial outside portions thereof, said hubs each having a bearing holding portion and a friction receiving surface;

(ii) biasing members each having an end face facing said friction receiving surface of said each hub, said biasing members being supported on said motor shaft so that said biasing members cannot rotate relative to said motor shaft but can move axially in relation to said motor shaft;

(iii) friction plates interposed between said friction receiving surfaces of said hubs and said biasing members;

(iv) at least one load setting and adjusting member disposed outside said biasing member and threadedly engaged to said motor shaft to be axially movable;

(v) elastic members interposed between said at least one load setting and adjusting member and said biasing members; and (vi) bearings interposed between said bearing holding portions of said hubs and said motor shaft, said rotor being supported on said motor shaft via said bearings at axially outside positions of said rotor so as to be rotatable relative to said motor shaft.

2. An electric hoist and traction apparatus comprising:

a motor comprising a stator and a rotor, said rotor having end rings at its axial opposite ends;

a motor shaft to be driven by said rotor;

a load sheave driven in association with said motor shaft;

an overload prevention device forming a driving connection between said motor shaft and said rotor for preventing a further hoisting operation when an overload is applied to said load sheave, said overload prevention device comprising:

(i) said end rings each having a bearing holding portion and a friction receiving surface, said bearing holding portion and friction receiving surface being formed on said end ring;

(ii) biasing members each having an end face facing said friction receiving surface of said each end ring, said biasing members being supported on said motor shaft so that it cannot rotate relative to said motor shaft but can move axially of said motor shaft;

(iii) friction plates interposed between said friction receiving surfaces of said end rings and said biasing members;

(iv) at least one load setting and adjusting member, disposed outside said biasing member and threadedly engaged to said motor shaft to be axially movable in relation to said motor shaft;

(v) elastic members interposed between said at least one load setting and adjusting member and said biasing members; and (vi) bearings interposed between said bearing holding portions of said end rings and said motor shaft, said rotor being supported on said motor shaft via said bearings at axially outside positions of said rotor so as to be rotatable relative to said motor shaft.

* * * * *